US009759538B2

(12) United States Patent
Nair

(10) Patent No.: US 9,759,538 B2
(45) Date of Patent: Sep. 12, 2017

(54) AUTO LOGGING OF ELECTRONIC DETONATORS

(71) Applicant: UTEC Corporation, LLC, Riverton, KS (US)

(72) Inventor: Nanda Kumar J. Nair, Hyderabad (IN)

(73) Assignee: UTEC Corporation, LLC, Riverton, KS (US)

( * ) Notice: Subject to any disclaimer, the term of this patent is extended or adjusted under 35 U.S.C. 154(b) by 0 days.

(21) Appl. No.: 15/232,535

(22) Filed: Aug. 9, 2016

(65) Prior Publication Data

US 2017/0234667 A1 Aug. 17, 2017

Related U.S. Application Data

(60) Provisional application No. 62/294,567, filed on Feb. 12, 2016.

(51) Int. Cl.

| | |
|---|---|
| ***F42D 1/045*** | (2006.01) |
| ***F42D 1/055*** | (2006.01) |
| ***F42D 1/04*** | (2006.01) |

(52) U.S. Cl.

CPC ..... *F42D 1/055* (2013.01); *F42D 1/043* (2013.01)

(58) Field of Classification Search

CPC . F42D 1/06; F42D 1/055; F42D 1/042; F42D 1/05; F42D 1/00; F42D 1/02; F42B 3/121; F42B 3/122

(Continued)

(56) References Cited

U.S. PATENT DOCUMENTS 4,489,655 A * 12/1984 Molnar ..... F42D 1/055 102/217
4,527,636 A * 7/1985 Bordon ..... E21B 43/1185 102/217

(Continued)

FOREIGN PATENT DOCUMENTS

CA 2341942 5/2004
WO WO2005005915 A2 1/2005

(Continued)

OTHER PUBLICATIONS

European Patent Office, International Search Report (including search strategy) and Written Opinion, PCT Application No. PCT/US2017/017183, international patent application corresponding to the above-referenced US application, completed Apr. 20, 2017, mailed May 2, 2017 (EPO, Rijswijk, NL).

*Primary Examiner* — Bret Hayes
*Assistant Examiner* — Derrick Morgan
(74) *Attorney, Agent, or Firm* — Mary M. Lee

(57) ABSTRACT

A blasting system with automated detonator logging eliminates on-the-field manual logging of each detonator. Detonators are connected in sequence in an auto-logging circuit, and the blast machine initiates a logging operation in which each detonator receives and confirms an assigned sequence number along with assigned delay data. Elimination of manual logging by individuals increases safety in the blast zone and facilitates the blasting operation. The operation is simplified, likelihood of human error is reduced, and the cost of a separate logger device is eliminated. An auto-logging protocol may be incorporated into the control module of the electronic detonator. Alternately, an auto-logging module may be connected externally to each detonator similar to the conventional surface plus down-the-hole delay systems. The inventive system may include an IDC connector that facili- (Continued)

tates the serial connection of the detonators for the logging circuit while allowing parallel connections of the blast control circuit.

15 Claims, 10 Drawing Sheets

(58) Field of Classification Search
USPC ..... 102/311, 202.9, 206, 215, 217
See application file for complete search history.

(56) References Cited

U.S. PATENT DOCUMENTS 4,718,954 A 1/1988 Machacek et al.
4,825,765 A * 5/1989 Ochi ..... F42D 1/055 102/200
4,848,232 A * 7/1989 Kurokawa ..... F42D 1/055 102/200
4,860,653 A * 8/1989 Abouav ..... F42B 3/122 102/200
4,869,171 A * 9/1989 Abouav ..... F42B 3/122 102/206
4,986,183 A * 1/1991 Jacob ..... F42D 1/055 102/200
5,042,594 A * 8/1991 Gonzalez ..... F42D 1/05 175/4.55
5,044,964 A * 9/1991 Minerd ..... H01R 23/667 439/498
5,064,382 A * 11/1991 Minnis ..... H01R 23/667 102/200
5,415,556 A * 5/1995 Schroll ..... H01R 13/665 439/516
5,460,093 A * 10/1995 Prinz ..... E21B 43/1185 102/215
5,536,897 A 7/1996 Clark et al.
5,608,184 A 3/1997 Machacek et al.
5,612,507 A 3/1997 Clark et al.
5,763,816 A 6/1998 Keeling
5,929,368 A 7/1999 Ewick et al.
6,214,140 B1 4/2001 Machacek et al.
6,283,227 B1 * 9/2001 Lerche ..... E21B 41/00 102/215
6,564,686 B1 5/2003 Keeling et al.
6,644,202 B1 * 11/2003 Duniam ..... F42D 1/055 102/215
6,722,251 B2 4/2004 Keeling et al.
6,752,083 B1 * 6/2004 Lerche ..... E21B 43/1185 102/202.5
6,945,174 B2 * 9/2005 Aebi ..... F42D 1/055 102/200
7,054,131 B1 5/2006 Kanth et al.
7,258,054 B1 8/2007 Keeling et al.
7,604,498 B2 * 10/2009 Mahajan ..... H01R 4/2404 174/71 R
7,694,627 B2 * 4/2010 Koekemoer ..... F42D 1/055 102/206
7,791,858 B2 * 9/2010 Hummel ..... F42D 1/05 102/262
7,975,612 B2 7/2011 Toewee et al.
8,390,979 B2 * 3/2013 Hurley ..... F42D 1/055 102/217
8,582,275 B2 * 11/2013 Yan ..... F42B 3/122 102/202
8,746,144 B2 * 6/2014 Givens ..... F42B 3/121 102/202.8
8,994,515 B2 * 3/2015 Guyon ..... F42D 1/055 102/215
9,250,051 B1 * 2/2016 Smith ..... F42D 1/05
2005/0011391 A1 * 1/2005 Jennings, III ..... F42D 1/055 102/206
2006/0130693 A1 6/2006 Teowee
2007/0240598 A1 * 10/2007 Koekemoer ..... F42D 1/055 102/215
2007/0249204 A1 * 10/2007 Petersen ..... F42D 1/043 439/208
2008/0098921 A1 * 5/2008 Labuschagne ..... F42D 1/055 102/202.5
2010/0288149 A1 * 11/2010 Schlenter ..... F42D 1/055 102/217
2015/0159986 A1 * 6/2015 Schlenter ..... F42D 1/055 102/311
2015/0241191 A1 * 8/2015 Garcia ..... F42D 1/042 102/311
2016/0187116 A1 * 6/2016 Teowee ..... F42D 1/05 102/215
2016/0218863 A1 * 7/2016 Schlenter ..... F42D 1/05

FOREIGN PATENT DOCUMENTS

WO WO2005008169 A2 1/2005
WO WO2005090895 A1 9/2005
WO WO2007118707 A2 10/2007

* cited by examiner

AUTO LOGGING OF ELECTRONIC DETONATORS

CROSS-REFERENCE TO RELATED APPLICATIONS

This application claims the benefit of U.S. provisional application No. 62/294,567 entitled "Auto Logging Detonator," filed Feb. 12, 2016, the contents of which are incorporated herein by reference.

FIELD OF INVENTION

The present invention relates generally to electronic detonators and more particularly, but without limitation, to devices and methods for logging electronic detonators.

DETAILED DESCRIPTION OF THE PREFERRED EMBODIMENTS

Figure 1:
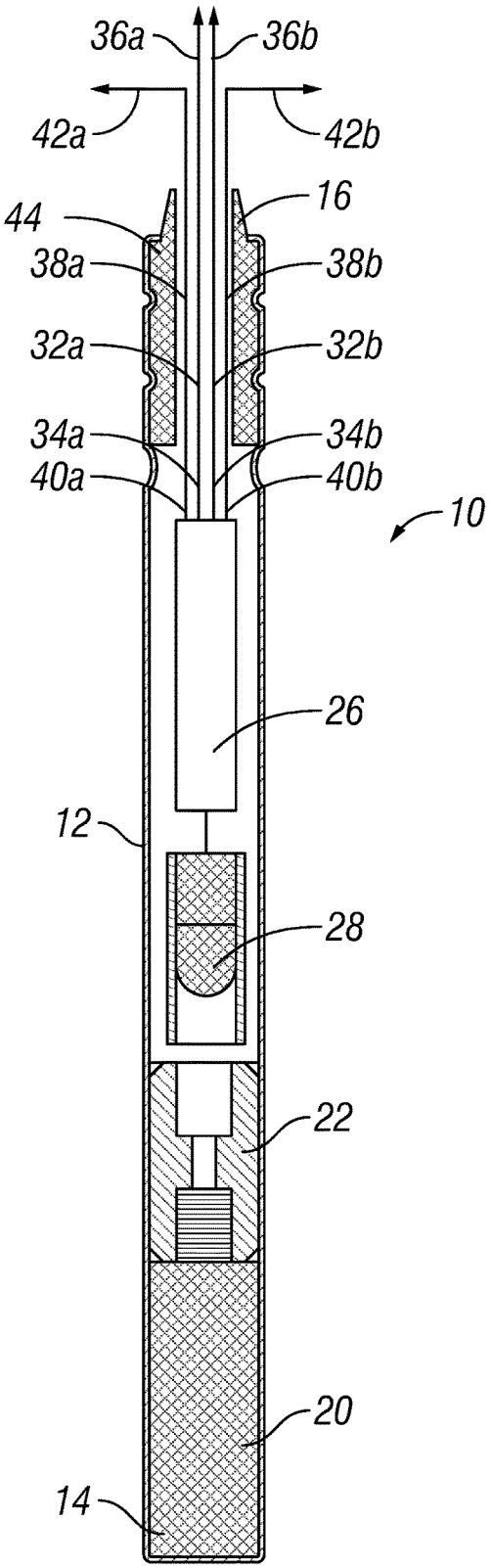
FIG. 1 is a schematic illustration of an electronic detonator constructed in accordance with a first preferred embodiment of the present invention. In this embodiment, the auto-logging module is integrated into the detonator's control circuit.

Electronic delay detonators are excellent initiation systems for controlled blasting especially in mining operations. Advantages of electronic detonators are precise timing resulting in reduced vibrations, improved protection from stray electrical currents and radio frequencies and, to an extent, reduction in misfires through precise circuit testing. Many types of electronic detonators are commercially available. Each manufacturer has different modes of operation for each model, which result in the similar functioning on the field.

Irrespective of the various designs and modes of operations of the electronic detonators in the market today, certain procedures usually are carried out while executing a blast operation. Individual detonators are tested, and the boreholes are charged. All the detonators are logged, and the identity of each detonator and its position in the blast pattern is recorded. The blast machine uses this identity to communicate with individual detonators to test, transfer delay data, and to fire the detonators.

The typical blast procedure also includes setting the delay time of each individual detonator according to the blast design. The delay time is transferred or programmed into the detonator either during the logging operation or by the blast machine during the blast procedure.

All the detonators are connected to the main line, and the line testing is conducted to confirm that all detonators are detected in the circuit. This is done by addressing each individual detonator using its specific identity.

In all cases, logging of the detonators on the field is mandatory to record the identity of each of the detonators with the blast hole. This is carried out either by physically connecting the detonator to the logging machine or by scanning the printed code on the detonator using an optical scanner.

The logging is done on the charged holes while the operator stands on it. This is a safety hazard, especially when the logging is done using a physical connection of the detonator; this is because the detonator is powered, even though a safe voltage is being used for logging. In the case of the optical scanning system, a connected logging will be required if the label on the detonator is damaged. Regardless of the method of identification that is employed, all current systems require an operator to physically visit each blast hole and perform some operation in order to carry out the procedure. This process is time consuming and inconvenient and often requires additional personnel in the field.

The present invention is directed to an electronic detonator with an auto-logging component that is either integrated in the circuitry of the detonator or in an external unit that is coupled to the detonator. The remote and automated logging process of this invention is carried out by communications between the blast machine and the detonators and eliminates the manual logging operation on the field.

The present invention includes detonator-to-detonator or "D2D" communication in addition to the conventional blast machine-to-detonator communications. The D2D communication is carried out on a logging line or cable that interconnects the detonators in sequence or series all in a logging circuit with the blast machine. Whether the blast system utilizes electronic detonators with internal auto-logging circuits or an external auto-logging unit, the basic operation is similar. As used herein, "logging circuit" refers to the interconnected components that are involved in the auto-logging operation and includes the blast machine, the detonators, and the logging line by which the blast machine communicates with the detonators. In the context of the present invention, where external auto-logging modules are utilized, the detonator logging units and the row logging units form a part of the logging circuit. While the auto-logging circuit and the blast control circuit have common components, the communication lines may be separate and independent.

The logging line that interconnects the detonators in series is in addition to the conventional two-wire blast lines, also called a bus line, that interconnect the detonators with the blast machine in a blast control circuit for execution of the blast program. As used herein, "blast control circuit" refers to the interconnected components of the blast operation and includes the blast machine, the detonators, and the data and communications lines by which the blast machine communicates with the detonators. In the context of the present invention, where external auto-logging modules are utilized, the auto-logging modules form a part of the blast control circuit.

The present invention also provides a specially designed insulation displacement connector ("IDC") for use when coupling the detonators to the three-wire bus line. The specialized IDC simplifies the serial or sequential connection of the electronic detonators in the logging circuit while also assuring a secure connection to the blast lines as well. Essentially, this connector performs a serialized connection while appearing similar to connectors that perform a parallel connection.

The present invention provides a blasting system in which automated remote electronic logging replaces the on-the-field logging of the detonators. This increases the safety of the on-field personnel and also reduces the time required for the overall set up process. These and other features and advantages will become apparent from the following description with reference to the accompanying drawings.

Turning now to the drawings in general and to FIG. 1 in particular, there is shown therein an electronic detonator made in accordance with a first embodiment of the present invention and designated generally by the reference number 10. The exemplary detonator 10 comprises a hollow tubular shell 12 with a blind or closed end 14 and an opposite open end 16. An explosive charge is contained in the blind end 14 of the shell 12. The explosive charge may include a base charge 20 and a primary explosive 22.

The detonator 10 includes a control module 26. The control module 26 may be a microcontroller or programmable logic device and more preferably comprises an application-specific integrated circuit chip (ASIC). The control module 26 is programmed to communicate with the blast machine and carry out a plurality of operations including a firing operation in a known manner. In accordance with the present invention, the control module 26 further includes an auto-logging function or module that may be integrated into the control module. The control module 26 is operatively connected to an igniter of any suitable type to initiate the detonation of the explosive charge. In the exemplary detonator shown in FIG. 1, the igniter is a fuse head 28.

First and second leg wires 32*a*, 32*b* have internal ends 34*a*, 34*b* connected to the control module 26 and external ends 36*a*, 36*b* outside of the shell 12 for connection to the blast control circuit, described hereafter. Logging wires 38*a*, 38*b* having internal ends 40*a*, 40*b* operatively connected to the control module 26 and external ends 42*a*, 42*b* outside of the shell 12 for connecting the control module to the logging circuit also described below. An end plug or sealing plug 44 may be crimped in the open end 16 of the shell 12.

Figure 2:
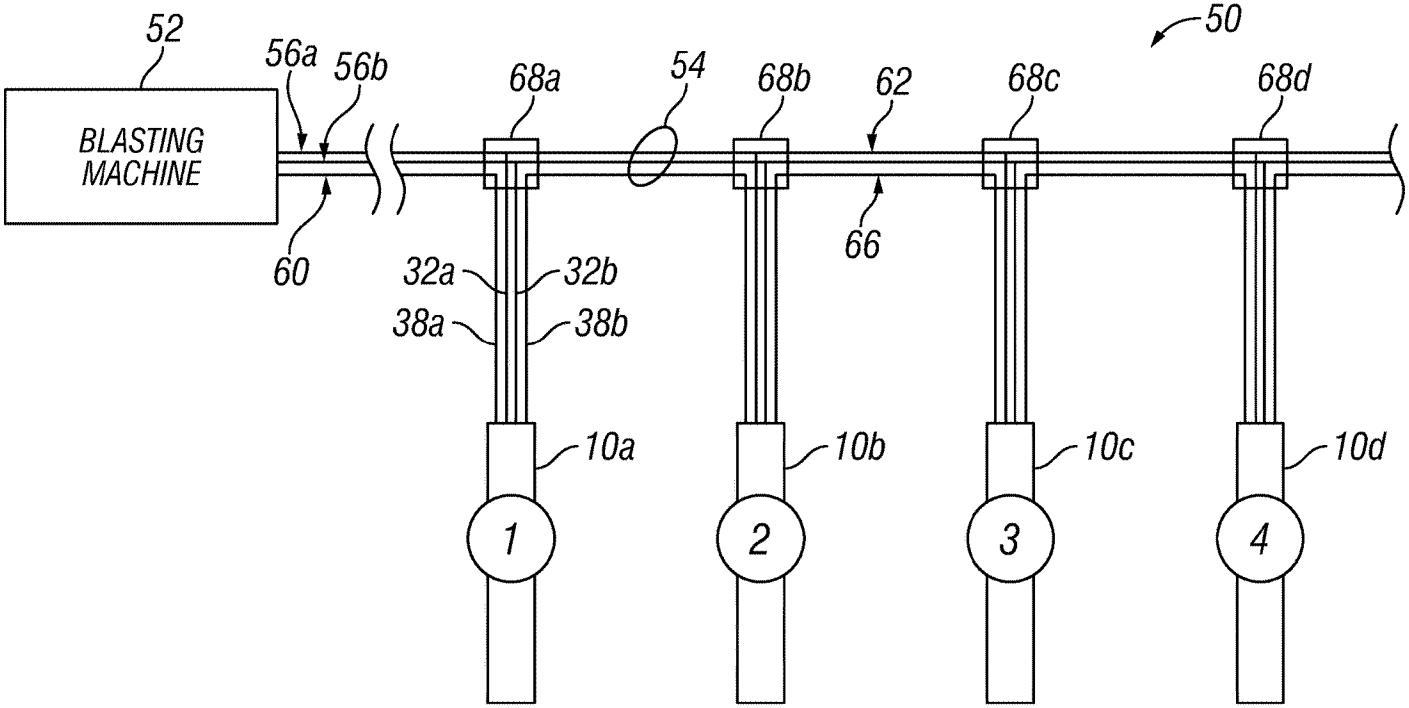
FIG. 2 is a field connection diagram for a blast system comprising a plurality of electronic detonators each with an internal auto-logging module as illustrated in FIG. 1.

Referring now to FIG. 2, therein is shown an illustrative blast system 50 using a plurality of electronic detonators like the detonator 10 interconnected with a blast machine 52 by a three-wire bus line 54. The bus line 54 comprises first and second blast lines 56*a* and 56*b* and a single logging line 60. While four detonators 10*a*, 10*b*, 10*c*, and 10*d* are shown, the blast system 50 may include a larger or smaller number of detonators. The detonators 10*a*, 10*b*, 10*c*, and 10*d* are connected to the first and second blast lines 56*a*, 56*b* by the leg wires 32*a*, 32*b* to form the blast control circuit 62. The logging wires 38*a*, 38*b* of the detonators 10*a*, 10*b*, 10*c*, and 10*d* also are connected to the logging line 60 to form the logging circuit 66.

Notably, as illustrated in the exemplary blasting system 50, the detonators 10*a*, 10*b*, 10*c*, and 10*d* are connected in a series in the logging circuit 66, as indicated by the numbers 1, 2, 3, and 4, while the detonators are connected in parallel pattern in the blast control circuit 62. The parallel arrangement of the detonators in the blast control circuit 62 is exemplary only; various other patterns (serial, parallel, etc.) and combinations of such patterns may be employed, as is commonly understood by those skilled in the art.

The leg wires 32*a*, 32*b* and the logging wires 38*a*, 38*b* of the detonators 10*a*, 10*b*, 10*c*, and 10*d* may be connected to the blast lines 56*a*, 56*b*, and the logging line 60 of the bus line 54 in any known manner. However, the present invention comprises a specially configured insulation displacement connector (IDC) 68*a*, 68*b*, 68*c*, 68*d*, one for each detonator 10*a*, 10*b*, 10*c*, and 10*d*.

A preferred embodiment of the inventive IDC will be described with reference to FIGS. 3 and 4. As the IDC's may be identically formed, only the IDC 68*a* will be described in detail. The IDC 68*a* comprises an enclosure or casing 70. Though not shown in detail, the casing 70 preferably will be formed of non-conductive material and most preferably will be waterproof. The casing 70 may include a cover, not shown, that is openable to access the connection structures inside.

The IDC 68*a* includes conductive elements configured to pierce the protective sheath on the various wires in order to establish an electrically conductive connection between the wires. To that end, the IDC 68*a* includes a first barb set 72 in the casing 70 for electrically connecting the first blast line 56*a* of the blast control circuit 62 (FIG. 2) with the first leg wire 32*a* of the detonator 10. A second barb set 74 is structured to electrically connect the second blast line 56*b* with the second leg wire 32*b* of the detonator 10. The first and second barb sets 72 and 74 are designed to connect the leg wires without severing the blast lines.

Figure 3:
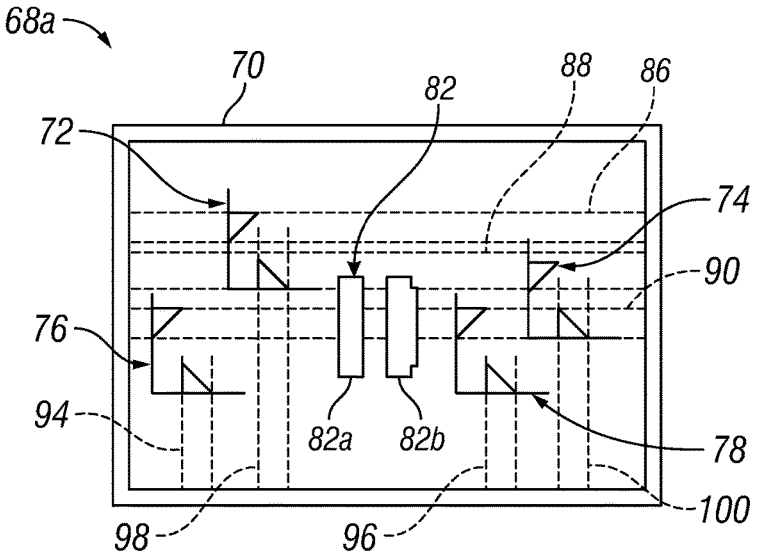
FIG. 3 is a schematic illustration of an insulation displacement connector ("IDC") customized for use in the blast system of the present invention.
Figure 4:
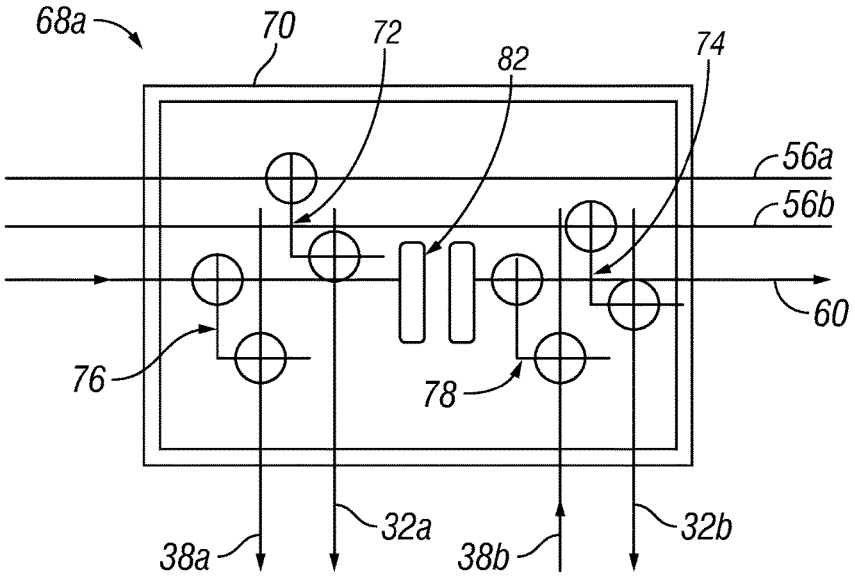
FIG. 4 is a schematic illustration of the IDC shown in FIG. 3 with the blast wires, logging wires, blast lines, and logging line all connected.

Referring still to FIGS. 3 and 4, the IDC 68*a* includes a third barb set 76 in the casing 70 for electrically connecting the logging line 60 of the logging circuit 66 (FIG. 2) to the first logging wire 38*a* of the detonator 10 and a fourth barb set 78 for electrically connecting the logging line to the second logging wire 38*b*. As indicated above, in the preferred practice of the invention, the detonators are connected in series in the logging circuit 66. To sever the logging line 60, the IDC 68*a* includes a line cutter 82 positioned between the third and fourth barb sets 76 and 78 for electrically severing the logging line 60. The line cutter preferably comprises a pair of blades 82*a* and 82*b*.

To facilitate the correct placement of the electrical conduits in the IDC 68*a*, the casing 70 may include a channel for each conductor. As used here, "channel" denotes any structure that services to position the conductor in the casing. Thus, "channel" includes a groove, recess, snap ring, cradle, or other such structure, and the channel may be a continuous or discontinuous structure. For that reason, the channels are shown only in broken lines and only in FIG. 3.

A indicated in FIG. 3, a first bus wire channel 86 is provided in the casing for receiving a section of the first blast line 56*a* of the blast control circuit 62. Also included is a second bus wire channel 88 for receiving a section of the second blast line 56*b*, and a third bus wire channel 90 for receiving a section of the logging line 60 of the logging circuit 66. A fourth channel 94 is formed in the casing for receiving a section of the first logging wire 38*a* of the detonator, and a fifth channel 96 is included for receiving a section of the second logging wire 38*b*. Still further, a sixth channel 98 is configured for receiving a section of the first leg wire 32*a*, and a seventh channel 100 is configured for receiving a section of the second leg wire 32*b*.

In this way, the interconnection of the leg wires and logging wires on each detonator can be quickly and correctly spliced with the three-line bus wire by placing the respective conductors in the appropriate channel. More importantly, the inventive IDC accomplishes this multi-wire connection while ensuring that the blast lines of the blast control circuit are not interrupted and that the logging line of the logging circuit is effectively severed. It will be appreciated that the inventive IDC devices may be sold separately or as part of a detonator and connector assembly, as in most instances a connector will be needed for each detonator.

Once the blast system 50 is fully assembled in the field, the detonators 10*a*, 10*b*, 10*c*, and 10*d* are logged. As indicated, the blast machine 52 (FIG. 2) and the control module 26 in each detonator are programmed to carry out an automated detonator logging operation that eliminates the need for personnel in the field. In accordance with the invention, the detonator logging operation includes the blast machine transmitting a unique detonator sequence number to each detonator. Each detonator accepts an assigned detonator sequence number from the blast machine in response to the logging status from an immediately preceding detonator in the series. Then, the detonator posts a "logged" status flag for output to the immediately succeeding detonator in the series.

Figure 5:
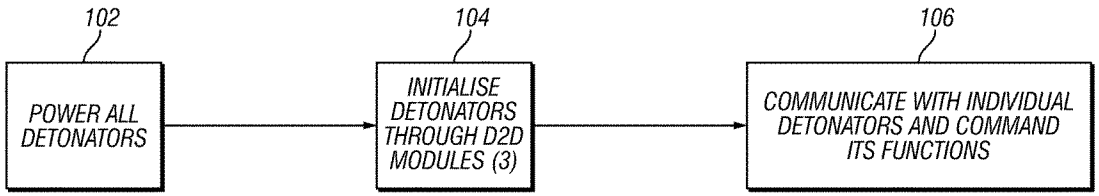
FIG. 5 shows a functioning block diagram showing the basic operation of a blasting system comprising a plurality of detonators each with an internal auto-logging module as illustrated in FIG. 1.

The detonator logging operation is summarized in the flow diagram of FIG. 5. The detonator logging operation commences with the blast machine 52 powering up all the detonators 10*a*, 10*b*, 10*c*, and 10*d*, as indicated at block 102. Next, at block 104, the blast machine 52 begins the initialization process by transmitting an initialization command on the logging line 60 (FIG. 2). Initially, only the first detonator 10*a* will respond to the "initialize" command, and the other detonators 10*b*, 10*c*, and 10*d* will reject the command since they are not enabled.

By means of the D2D communication on the logging circuit, as indicated at block 106, the blast machine 52 will assign the first detonator 10*a* detonator sequence number 1, and the first detonator will confirm acceptance of the detonator sequence number assigned to it. The logged detonator 10*a* will then post its status as "logged" for signalling to the next detonator 10*b*. The blast machine 52 then repeats the initialization command and sends the detonator sequence number 2 to the second detonator 10*b*. Upon confirming the "logged" status of the immediately preceding detonator (in this case detonator 10*a*), the second detonator 10*b* accepts the sequence number "2" posts its status now as "logged," which will then enable the next detonator for initialization.

This process repeats until all detonators in the series have responded. When no further "initialized" signals are received from the logging circuit, the blast machine ends the detonator logging operation. At this point, the blast machine has associated a specific sequence number with each detonator allowing detonator-specific communication to execute other commands as necessary to complete the blast operation.

Figure 6:
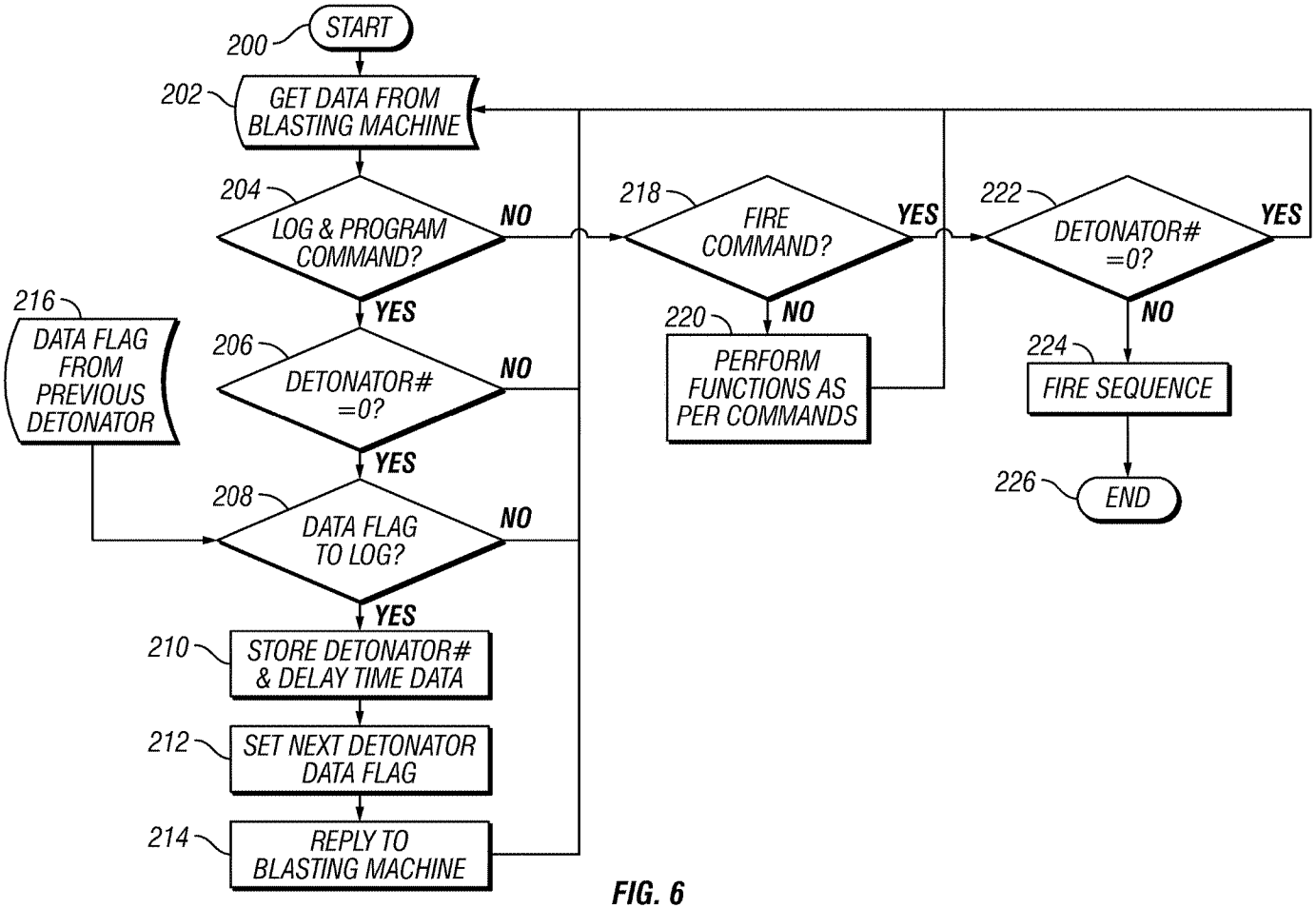
FIG. 6 is a functional flow diagram illustrating the auto-logging logic carried out by the control module of the auto-logging detonator show in FIG. 1.

Turning now to FIG. 6, the functional logic of the detonator logging operation performed by the control module 26 in the detonator 10 will be explained in more detail. At START 200, the detonator gets power from the blast machine 52. All initializing routines are run, and the detonator is ready to receive commands from the blast machine. The detonator sequence number and delay time data stored in the module's memory are reset to zero.

At 202, the detonator receives data from the blast machine 52. This data includes the command signal to do specific processes, an assigned detonator sequence number, and the delay time data. At 204, the detonator verifies whether the command is to commence the detonator logging operation. If the command is for logging, then at 206 the program determines if the assigned sequence number ("detonator #") in its memory is zero or greater than zero. If the Detonator # is greater than zero or "no," the detonator is already logged, and the program returns to 202 for a new command.

If, at block 206, the Detonator # in memory is zero or "yes," then the program proceeds to block 208 and checks the data flag from the previous detonator, if any, at 216. If the flag of the preceding detonator is not set, or the response to the query at 208 is "no," the log command is not for this detonator, and the logic returns to 202 for the next command. If the flag at 216 is set, or the response to the query at 208 is "yes," then the logging operation proceeds to block 210, and the detonator stores the received sequence number in its memory along with the updated delay time data.

Next, at block 212, the detonator will set the data flag output connected to the next detonator in series. This "logged" status will be detected by the next detonator in the series when it conducts its logging operation. Finally, after posting its "logged" status data flag, at 214 the detonator replies to the blast machine that the logging process is completed.

At block 204, if the initial response is "no," that is, if the command is not for logging, the program proceeds to 218 and checks if the command is to commence the firing operation. If "no," then the command is for another function, and the program proceeds to perform such other functions 220 as commanded and returns to the "receive data" station at 202. If at 218, the command is for firing or "yes," the program proceeds to block 222, and again queries the memory for the stored detonator sequence number. If the stored sequence number is zero, the detonator is not logged and the program returns to step 202 for further commands. If the stored sequence number is greater than zero, then the "logged" status is verified, and the program proceeds to execute the fire command at block 224 whereupon the operation is ended at 226.

Figure 7:
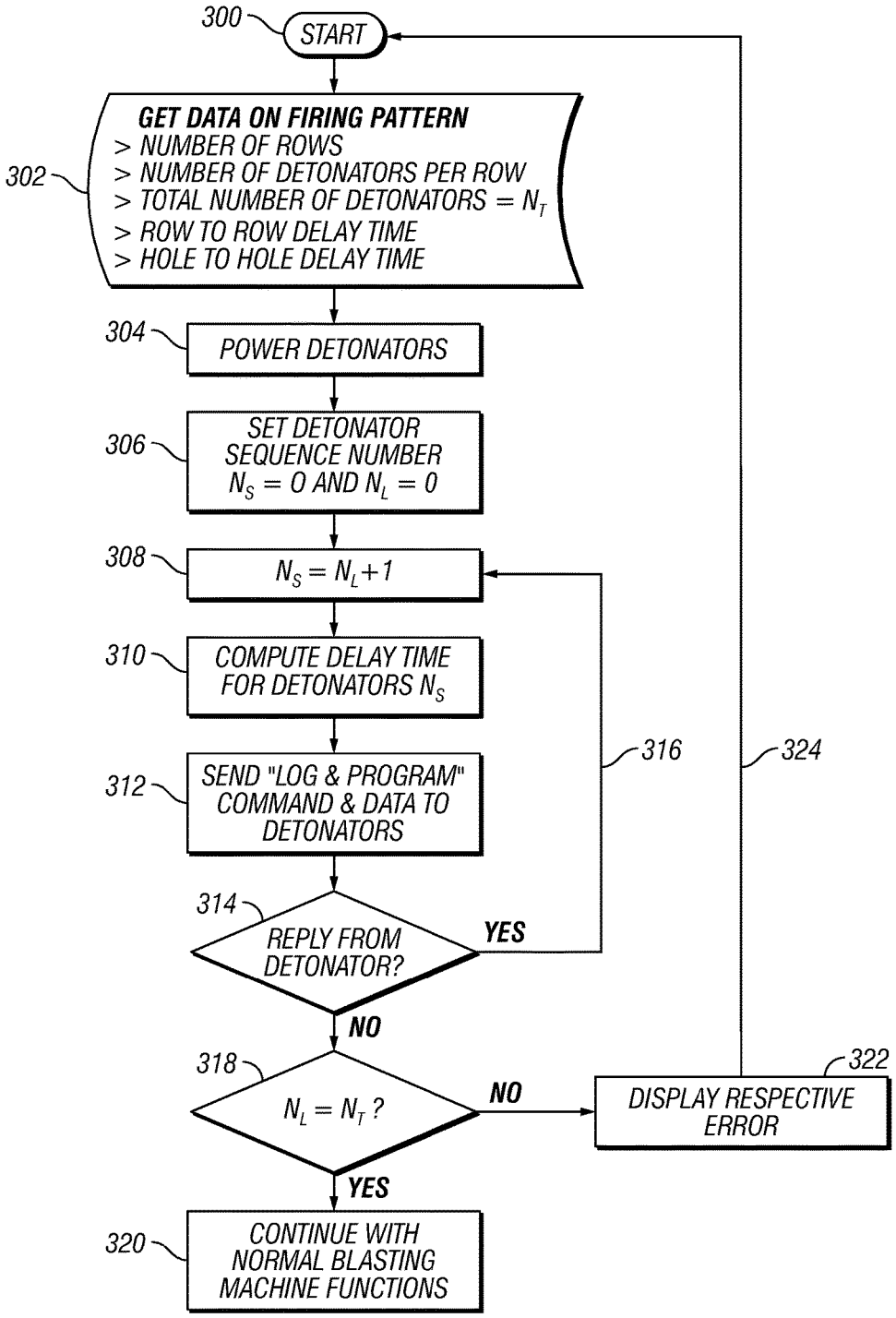
FIG. 7 is a functional flow diagram illustrating the auto-logging logic carried out by the blast machine in a blasting system employing the auto-logging detonator show in FIG. 1.

With reference now to FIG. 7, the logic employed by the blast machine 52 in relation to the automatic detonator logging operation will be described. Commencing at START 300, the blast machine 52 (FIG. 2) is initialized and is ready to function. The blast machine assumes that all the detonators 10*a*, 10*b*, 10*c*, and 10*d* are connected in the logging circuit 66 in series. For example, if the blast pattern has multiple rows, as in subsequent embodiments described below, the machine assumes that the last detonator in the first row is connected to the first detonator in the second row, and so forth.

At 302, the blast machine receives input from the operator for the blasting operation. This data includes blast pattern, including how many rows of detonators, and how many detonators in each row ("holes per row"). This data also includes delay times for each detonator, including row-to-row delay time values and hole-to-hole delay time values. In particular, the data includes to the total number of detonators in the blast pattern designated as "$N_T$."

At 304, in response to a LOG Command from the operator, the blast machine switches on the detonator power, and all the connected detonators are powered. The blast machine sends out a LOG command to each detonator in sequence along with the delay time data for that specific detonator. Additionally, before initiating the logging operation, the detonator's assigned sequence number "$N_S$" and the number of detonators logged "$N_L$" are reset to zero at block 306. At block 308, as the logging operation progresses, the blast machine incrementally increases the detonator sequence number $N_S$ as each detonator is logged.

As indicated, $N_S$ is the sequence number of the detonator connected in the field. From the blast operation data input at step 302, the blast machine computes the position of the detonator (row# and hole#) with this sequence number $N_S$. The delay time for that detonator is computed using the delay time data from step 302. For example, the following formula may be employed:

$$\text{Delay Time}=((\text{row\#}-1)\times\text{row delay})+((\text{hole\#}-1)\times\text{hole delay})$$

where the row# and hole# start from 1.

At step 312, the blast machine sends the data to the detonators connected on the field. This data includes the command to log the detonator, the detonator number, and the respective delay time value. At step 314, this data is received by the respective detonator on the field, and the detonator replies to the blast machine. The blasting machine will not proceed without a reply from the detonator at step 314. If the response at block 314 is "yes," the logic returns at 316 to step 308, whereupon the detonator number $N_S$ is ticked up and the operation proceeds to log the next detonator in the sequence. If no reply is received from the detonator at 314 after a predetermined interval of time, this indicates that all detonators have been logged, and the logic moves to step 318.

At 318, after receiving no further replies from detonators in the field, the logic then compares the total number of detonators logged "$N_L$," with the pre-programmed number of total detonators in the blast operation, $N_T$, which was input at 302. If $N_L$ equals $N_T$, the logic proceeds to step 320 and completes the rest of the blasting program. If $N_L$ does not equal $N_T$, the logic displays an error at 322 and returns to START 300 of the operation.

At the completion of the logging operation, all the detonators in the blast operation are logged, each detonator has received and accepted its own unique detonator-specific sequence number. This number can be used by the blast machine to communicate with individual detonators to perform operations like diagnostics or modification of programmed delay time data etc. The remainder of the blast operation is carried out according to conventional procedures.

Figure 8:
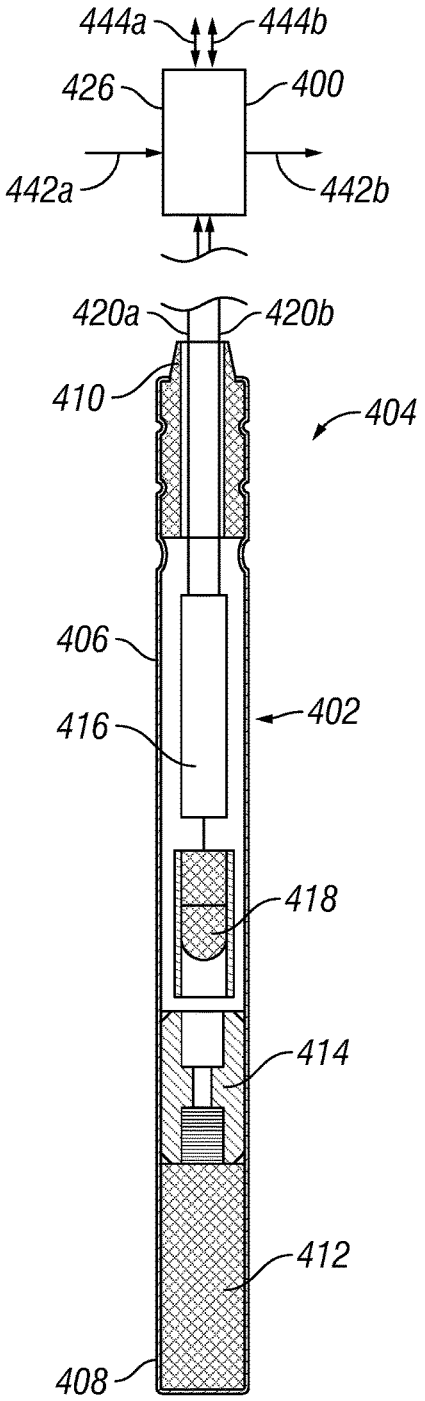
FIG. 8 is a schematic illustration of an electronic detonator assembly constructed in accordance with a second preferred embodiment of the present invention. The electronic detonator assembly comprises a conventional electronic detonator electrically coupled to an external detonator logging unit.
Figure 8A:
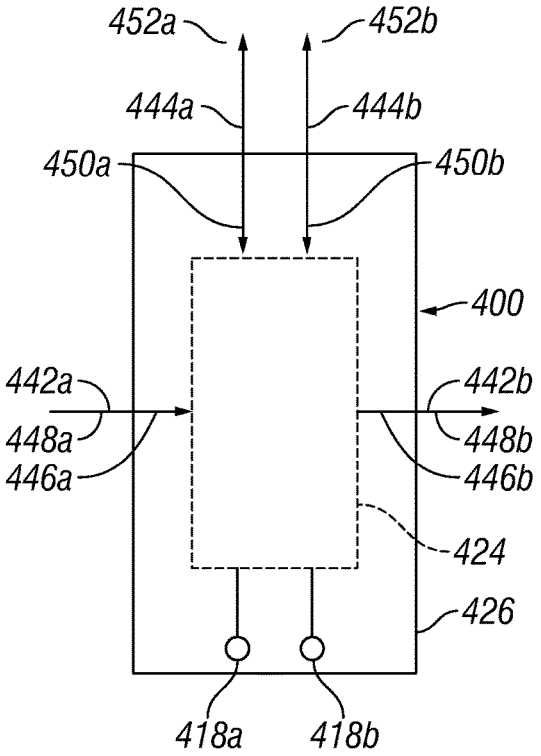
FIG. 8A is an enlarged schematic illustration of the detonator logging unit 400 shown in FIG. 8.

In the previous embodiment, the control module 26 of the detonator 10 was programmed to include the detonator logging module, as previously described. In some instances, it may be desirable to provide an external or separate detonator logging unit. One preferred embodiment of an external detonator logging unit is shown in FIGS. 8 and 8A, to which we now turn. In FIG. 8, the detonator logging unit 400 is shown electrically coupled to a conventional electronic detonator 402 forming a detonator-logging assembly 404 comprising an electronic detonator and the detonator logging unit. The exemplary detonator 402 comprises a hollow tubular shell 406 with a blind or closed end 408 and an opposite open end 410. An explosive charge is contained in the blind end 408. The explosive charge may include a base charge 412 and a primary explosive 414.

The detonator 402 includes a control module 416. The control module 416 may be a microcontroller or programmable logic device and more preferably comprises an application-specific integrated circuit chip (ASIC). The control module 416 is programmed to communicate with the detonator logging unit 400. The detonator logging unit 400 is equipped with terminals 418*a*, 418*b* (FIG. 8A) to electrically connect to the leg wires 420*a* and 420*b*. The detonator 402 communicates with the blast machine (not shown in this figure) through the detonator logging unit 400. The control module 416 is operatively connected to an igniter of any suitable type, such as the fuse head 418, to initiate the detonation of the explosive charge.

Although separate and self-contained, the detonator logging unit 400 is similar in its functions and programming to the logging operation of the electronic detonator 10 in the previous embodiment. To that end, the detonator logging unit 400 may comprise a logging module 424 contained in a suitable housing 426. As indicated, the housing 426 includes terminals 418*a*, 418*b* by which the logging module 424 is operatively connectable to the leg wires 420*a* and 420*b* of the electronic detonator 402.

Figure 9:
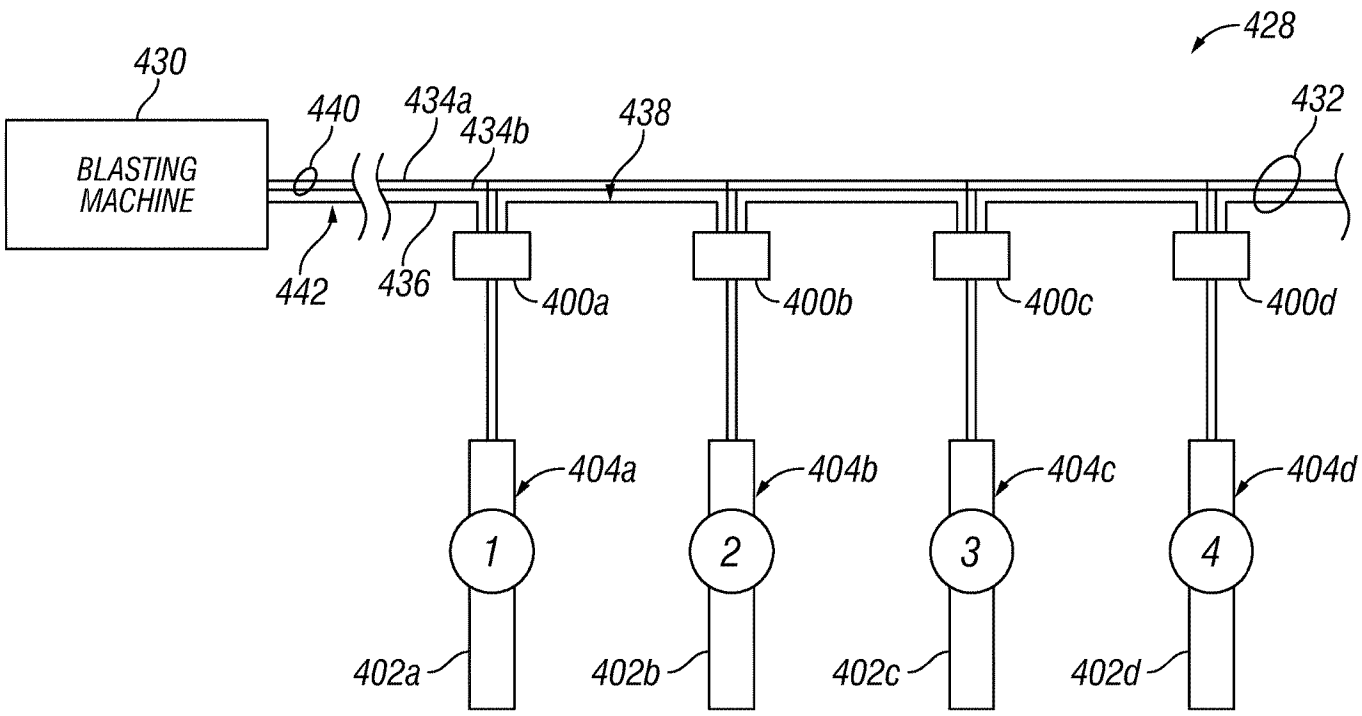
FIG. 9 is a field connection diagram for a blast system comprising a plurality of electronic detonator and logging unit assemblies illustrated in FIG. 8.

The detonator logging unit 400 may form part of a blast system 428 depicted in FIG. 9 in a manner similar to the previous embodiment. The blast system 428 comprises a blast machine 430 that is connected with a plurality of detonator-logging units 400*a*, 400*b*, 400*c*, and 400*d* by a three-wire bus line 432. The bus line 432 comprises first and second blast lines 434*a* and 434*b* and a logging line 436. The blast lines 434*a* and 434*b* connect the detonator-logging units 400*a*, 400*b*, 400*c*, and 400*d* in a blast control circuit 440, and the logging line 436 connects the detonator-logging units 400*a*, 400*b*, 400*c*, and 400*d* in a logging circuit 442.

As best seen in FIG. 8A, the detonator logging unit 400 comprises first and second logging wires 442*a* and 442*b* and first and second blast wires 444*a* and 444*b*. As seen in FIG. 8A, the first and second logging wires 442*a* and 442*b* have internal ends 446*a*, 446*b* operatively connected to the logging module 424. The external ends 448*a* and 448*b* of the first and second logging wires 442*a* and 442*b* are outside of the housing 426 for connecting the logging module 424 to the logging module of the detonator logging unit associated with the immediately preceding electronic detonator in the logging circuit 442 (FIG. 9) and the logging module of the of the detonator logging unit associated with the immediately succeeding electronic detonator in the logging circuit, as shown in FIG. 9.

Referring still to FIG. 8A, the first and second blast wires 444*a* and 444*b* have internal ends 450*a* and 450*b* operatively connected to the logging module 424 and external ends 452*a* and 452*b* outside of the housing 426 for connecting the detonator logging unit to the blast control circuit 440 (FIG. 9). Thus, the detonator logging unit 400 is interposed between the leg wires 420*a* and 420*b* of the electronic detonator 402 and the blast circuit 440 (FIG. 9).

As indicated, the logging module 424 of the external detonator logging unit 400 is programed to carry out the same logging operation as previously described in relation to the detonator 10. However, now it will be appreciated that the external logging unit 400 conveniently may also function as a conventional surface connector. For example, positioned outside the shell as a programmable surface connector the unit 400 may operate as a "Hole to Hole delay" and "Row to Row delay," as is done in conventional blast design using "Surface delay+DTH" combination. Still further, although not depicted in FIGS. 8 and 9, the logging units 400*a*, 400*b*, 400*c*, and 400*d* may be connected to the bus wire 432 by using the IDC connectors, as previously described.

Figure 10:
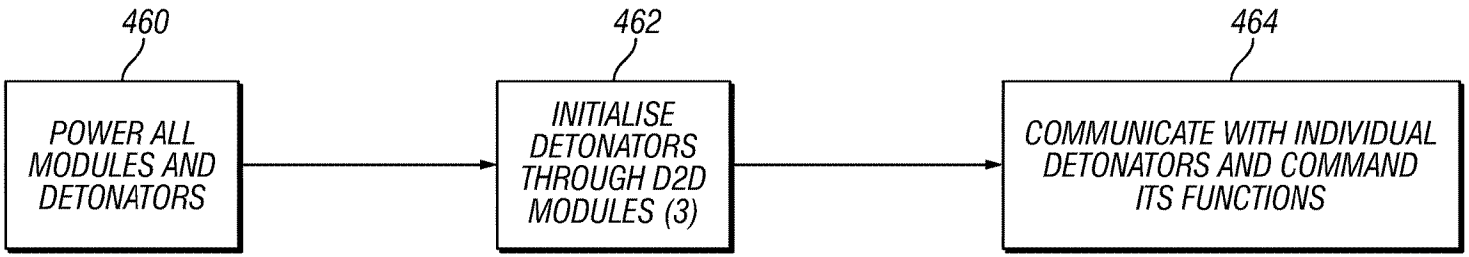
FIG. 10 shows a functioning block diagram showing the basic operation of a blasting system comprising a plurality of electronic detonator and logging unit assemblies as illustrated in FIG. 9.

The detonator logging operation for the blast system 428 (FIG. 9) is summarized in the flow diagram of FIG. 10. The detonator logging operation commences with the blast machine 430 powering up all the detonator logging units 400*a*, 400*b*, 400*c*, and 400*d*, and associated detonators 402*a*, 402*b*, 402*c*, and 402*d*, as indicated at block 460. Next, at block 462, the blast machine 430 begins in the initialization process by transmitting an initialization command on the logging line 436 (FIG. 9). Initially, only the first detonator logging units 400*a* will respond to the "initialize" command, and the other detonator logging units 400*b*, 400*c*, and 400*d* will reject the command since they are not enabled.

By means of the D2D communication on the logging circuit 442, indicated at block 464, the blast machine 430 will assign the first detonator-logging unit 400*a* detonator sequence number 1, and the first detonator logging unit 400*a* will confirm acceptance of the detonator sequence number and assign it to the detonator 402*a* connected to it. The logged detonator logging unit 400*a* will then post its status as "logged" and will set the data flag output connected to the next detonator-logging unit 400*b*. The blast machine 430 then repeats the initialization command and sends the detonator sequence number 2 that will be accepted only by the detonator-logging unit 400*b*. The second detonator-logging unit 400*b* accepts the sequence number "2" posts its status now as "logged," which will then enable the next detonator-logging unit for initialization.

This process repeats until all the detonator-logging units 400*a*, 400*b*, 400*c*, and 400*d* in the series have responded after initiating the connected detonators 402*a*, 402*b*, 402*c*, and 402*d*, respectively. When no further "initialized" signals are received from the logging circuit, the blast machine ends the detonator logging operation. At this point, the blast machine has associated a specific sequence number with each detonator in the system allowing detonator-specific communications to execute other commands as necessary to complete the blast operation.

Figure 11:
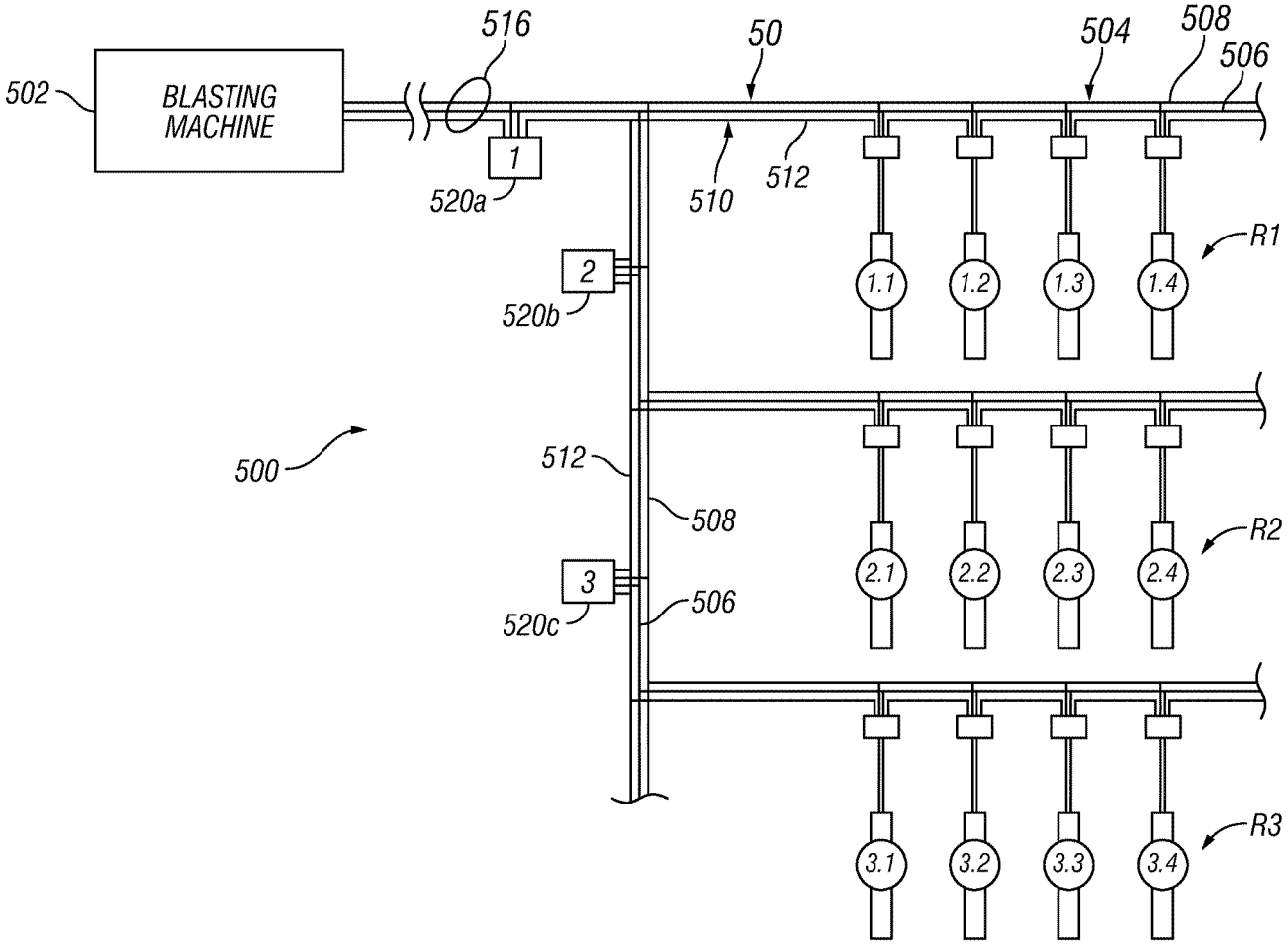
FIG. 11 is a field connection diagram for a blast system comprising multiple rows of electronic detonator assemblies shown in FIG. 8 and further comprising row-to-row row logging units.

The previously described blast systems 50 and 428 illustrate examples of blast patterns that comprise a single row of electronic detonators. However, many blast systems comprise detonators arranged in a plurality of rows. An example of such a blast pattern is illustrated in FIG. 11, to which attention now is directed.

The multi-row blast system, designated generally at 500, comprises three (3) rows R1, R2, and R3 of four (4) detonators each. Each of the detonators is shown as part of a detonator-logging unit comprising a detonator and an external or surface detonator logging unit, as described above in connection with FIGS. 8-10. It will be understood that a multi-row blast system alternately could employ the detonators with the built-in logging module. The blast system 500 comprises a blast machine 502 interconnected in a blast control circuit 504 by first and second blast lines 506 and 508 and also interconnected in a logging circuit 510 by a logging line 512. The blast lines 506 and 508 and logging line 512 form a three-wire bus line 516, as in the previous embodiments.

In accordance with the present invention, the multi-row blast system 500 further comprises a plurality of row logging units 520*a*, 520*b*, and 520*c*, including a row logging unit operatively associated with a different one of each of the plurality of rows R1, R2, and R3. As with the detonator logging units previously described, the row logging units 520*a*, 520*b*, and 520*c*, are interposed in the logging circuit 510 in series by the logging line 512. The customized IDC connectors previously described may also be used to connect the row logging units 520*a*, 520*b*, and 520*c* to the bus line 516. The row logging units 520*a*, 520*b*, and 520*c* provide row-to-row ("R2R") communication similar to the detonator-to-detonator or D2D communication provided by the detonator logging units.

Each of the row logging units 520*a*, 520*b*, and 520*c* may comprise a housing and a row logging module in the housing. As these units are similar to the units 400 of the previous embodiment, they are not shown or described in detail. Each of the row logging units 520*a*, 520*b*, and 520*c* is configured to execute a plurality of operations including a row logging operation. The blast machine 502 and the row logging units 520*a*, 520*b*, and 520*c* carry out a row logging operation that corresponds to the detonator logging operation previously explained.

The row logging operation includes accepting an assigned row sequence number (Row 1.0, Row 2.0, Row 3.0, etc.) from the blast machine 502 in response to row logging status from an immediately preceding row logging unit in the series of row logging units and posting row logging status for output to an immediately succeeding row logging unit in the series. Each of the row logging units 520*a*, 520*b*, and 520*c* is configure to receive and store in its memory row logging data from the blast machine 502. The row logging data from the blast machine 502 comprises an assigned row number that is zero or a number greater than zero. The row logging operation includes completing the row logging operation if the assigned row number in the memory is zero and ending the row logging operation if the assigned row number is greater than zero.

The row logging operation includes checking for row logging status posted by the immediately preceding row logging unit in the logging circuit and ending the row logging operation if no logging status is detected for the immediately preceding row logging unit. If a "logged" status is detected for the immediately preceding row logging unit, the row logging operation is completed by accepting the assigned row number received from the blast machine, posting a "logged" status for output to an immediately succeeding row logging unit in the logging circuit, and signalling to the blast machine that the row logging operation is completed. Preferably, the blast machine is configured to complete the row logging operation prior to starting the detonator logging operation.

Figure 12:
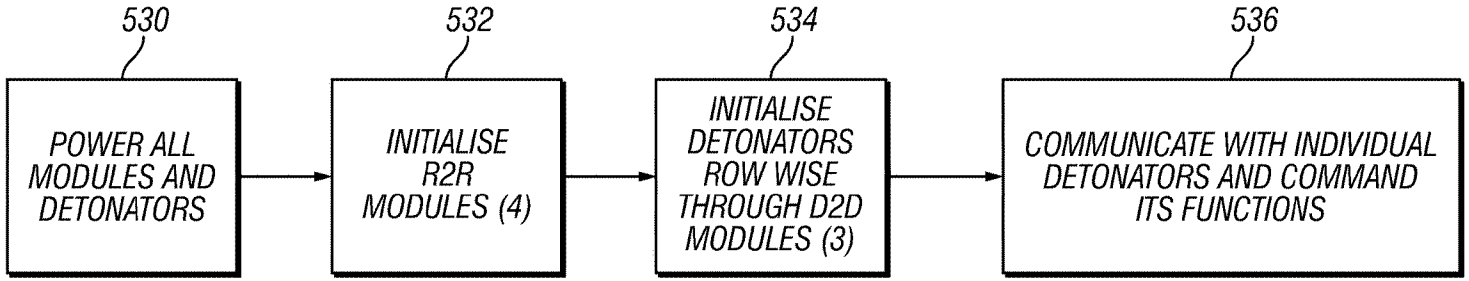
FIG. 12 shows a functioning block diagram showing the basic operation of a blasting system comprising a plurality of electronic detonator assemblies and row logging units as illustrated in FIG. 11.

The detonator logging operation for the blast system 500 (FIG. 11) is summarized in the flow diagram of FIG. 12. The detonator logging operation commences at block 530 with the blast machine 502 powering up all the detonator logging units and associated detonators of the detonator-logging assemblies. Next, at step 532, the blast machine 502 initializes the row logging or R2R units. Then, at block 534, the blast machine 502 initializes the detonators, one row at a time, using the D2D detonator logging units. Thus, the blast machine 502 in this embodiment is configured to complete the row logging operation prior to starting the detonator logging operation.

Once all detonator logging units and row logging units have been successfully logged, the blast machine is able to use the unique identifier for each unit to communicate with individual logging units and detonators to perform the blasting operation or other functions. It should be noted that the identifier assigned to each detonator indicates which row the detonator is in and what number the detonator is in the row. That is, the assigned identifier should contain the row and the hole numbers. For example, the second detonator in the third row will be identified as number 3.2

Now it will be appreciated that the present invention provides a system and method by which the process of logging detonators in a blast operation is made more safe and more efficient. In addition to the conventional blast control circuit, the system includes a logging circuit. Regardless of the blast pattern of the detonators, the logging circuit connects the detonators in a series.

The first detonator in the series, that is, the detonator connected directly to the blast machine, will identify itself as the first detonator in the circuit and then activate the next detonator in the series. The second detonator, then, in turn, will tag itself as detonator number two and activate the next in the circuit in a relay-like protocol. In this way, each detonator becomes associated with a unique identifier, which is its sequence number in the blast pattern. The blast machine can then use the unique identifiers to communicate with individual detonators.

The embodiments shown and described above are exemplary. Many details are often found in the art and, therefore, many such details are neither shown nor described herein. It is not claimed that all of the details, parts, elements, or steps described and shown were invented herein. Even though numerous characteristics and advantages of the present invention have been shown in the drawings and described in the accompanying text, the description and drawings are illustrative only. Changes may be made in the details, especially in matters of shape, size, and arrangement of the parts, within the principles of the inventions to the full extent indicated by the broad meaning of the terms of the attached claims. The description and drawings of the specific embodiments herein do not point out what an infringement of this patent would be, but instead provide an example of how to use and make the invention. Likewise, the abstract is neither intended to define the invention, which is measured by the claims, nor is it intended to be limiting as to the scope of the invention in any way. Rather, the limits of the invention and the bounds of the patent protection are measured by and defined in the following claims.

What is claimed is:

1. An electronic detonator for use in a blasting system comprising a blast machine and a plurality of electronic detonators controlled by the blast machine, wherein all of the plurality of electronic detonators are interconnected with the blast machine in a series in a logging circuit, wherein all of the plurality of electronic detonators are interconnected with the blast machine in a blast control circuit, wherein each of the plurality of electronic detonators comprises:

a shell;

an explosive charge in the shell;

an igniter in the shell operatively connected to the explosive charge;

a control module in the shell operatively connected to the igniter, the control module configured to execute a plurality of operations including a firing operation and a detonator logging operation, wherein the detonator logging operation includes accepting an assigned detonator sequence number from the blast machine in response to logging status from an immediately preceding detonator in the series and posting logging status for output to an immediately succeeding detonator in the series, and wherein the firing operation includes actuating the igniter in response to blast control data from the blast machine;

first and second leg wires having internal ends operatively connected to the control module and external ends outside of the shell for connecting the control module to the blast control circuit; and first and second logging wires having internal ends operatively connected to the control module and external ends outside of the shell for connecting the control module to the logging circuit.

2. The electronic detonator of claim 1 wherein the control module comprises a memory and wherein the detonator logging operation is configured to receive and store in the memory detonator logging data from the blast machine.

3. The electronic detonator of claim 2 wherein the logging data from the blast machine comprises an assigned detonator sequence number that is zero or a number greater than zero, and wherein the detonator logging operation includes completing the detonator logging operation if the assigned detonator sequence number in the memory is zero and ending the detonator logging operation if the assigned detonator sequence number is greater than zero.

4. The electronic detonator of claim 3 wherein the detonator logging operation includes checking for logging status posted by the immediately preceding detonator in the logging circuit and ending the detonator logging operation if no logging status is detected for the immediately preceding detonator and completing the detonator logging operation if a logged status is detected for the immediately preceding detonator by accepting the assigned detonator sequence number received from the blast machine, posting a logged status flag for output to an immediately succeeding detonator in the logging circuit, and signalling to the blast machine that the logging operation is completed.

5. A blasting system comprising a blast machine and a plurality of electronic detonators as defined in claim 4.

6. The blasting system of claim 5 wherein the plurality of electronic detonators are arranged in a single row.

7. The blasting system of claim 6 wherein the plurality of electronic detonators are arranged in a plurality of rows including a first row and a second row and wherein the blasting system further comprises a plurality of row logging units including a row logging unit operatively associated with a different one of the plurality of rows of detonators, wherein the plurality of row logging units are interposed in the logging circuit in series, wherein each of the plurality of row logging units comprising a housing and a logging module in the housing configured to execute a plurality of operations including a row logging operation, wherein the row logging operation includes accepting an assigned row number from the blast machine in response to row logging status from an immediately preceding row logging unit in the series of row logging units and posting row logging status for output to an immediately succeeding row logging unit in the series of row logging units.

8. The blasting system of claim 7 wherein the row logging operation is configured to receive and store in the memory of the control module row logging data from the blast machine.

9. The blasting system of claim 8 wherein the row logging data from the blast machine comprises an assigned row number that is zero or a number greater than zero, and wherein the row logging operation includes completing the row logging operation if the assigned row number in the memory is zero and ending the row logging operation if the assigned row number is greater than zero.

10. The blasting system of claim 9 wherein the row logging operation includes checking for row logging status posted by the immediately preceding row logging unit in the logging circuit and ending the row logging operation if no logging status is detected for the immediately preceding row logging unit and completing the row logging operation if a logged status is detected for the immediately preceding row logging unit by accepting the assigned row number received from the blast machine, posting a logged status for output to an immediately succeeding row logging unit in the logging circuit, and signalling to the blast machine that the row logging operation is completed.

11. The blasting system of claim 10 wherein the blast machine is configured to complete the row logging operation prior to starting the detonator logging operation.

12. A detonator and connector assembly comprising the electronic detonator of claim 1 and an insulation displacement connector (IDC), wherein the blast control circuit comprises first and second blast lines and wherein the logging circuit comprises a logging line, the IDC comprising:

a casing;

a first bus wire channel in the casing for receiving a section of the first blast line of the blast control circuit;

a second bus wire channel in the casing for receiving a section of the second blast line of the blast control circuit;

a third bus wire channel in the casing for receiving a section of the logging line of the logging circuit;

a fourth channel in the casing for receiving a section of the first logging wire of the detonator;

a fifth channel in the casing for receiving a section of the second logging wire of the detonator;

a sixth channel in the casing for receiving a section of the first leg wire of the detonator;

a seventh channel in the casing for receiving a section of the second leg wire of the detonator;

a first barb set in the casing for electrically connecting the first blast line of the blast control circuit with the first leg wire of the detonator;

a second barb set in the casing for electrically connecting the second blast line of the blast control circuit with the second leg wire of the detonator;

a third barb set in the casing for electrically connecting the logging line of the logging circuit to the first logging wire of the detonator;

a fourth barb set in the casing for electrically connecting the logging line of the logging circuit to the second logging wire of the detonator; and a line cutter between the third and fourth barb sets for electrically severing the logging line of the logging circuit.

13. The detonator and connector assembly of claim 12 wherein the line cutter comprises two blades.

14. A blasting system comprising a blast machine and a plurality of electronic detonators and connector assemblies as defined in claim 12.

15. A blasting system comprising a blast machine and a plurality of electronic detonators as defined in claim 12.

* * * * *